United States Patent [19]

Orlob

[11] 4,375,725

[45] Mar. 8, 1983

[54] OPTICAL SIGHT

[76] Inventor: Douglas A. Orlob, 603 Pearson, Walla Walla, Wash. 99362

[21] Appl. No.: 235,097

[22] Filed: Feb. 17, 1981

[51] Int. Cl.[3] ..... F41G 1/32

[52] U.S. Cl. ..... 33/233; 33/241; 33/265

[58] Field of Search ..... 33/233, 241, 265; 42/1 S, 1 ST; 356/251, 247; 350/10

[56] References Cited

U.S. PATENT DOCUMENTS

| | | | |
|---|---|---|---|
| 649,194 | 5/1900 | Carver | 356/247 |
| 944,916 | 12/1909 | Shepard | 356/247 |
| 2,287,032 | 6/1942 | Garand | 33/233 |
| 3,914,873 | 10/1975 | Elliott et al. | 33/241 |

FOREIGN PATENT DOCUMENTS

| | | | |
|---|---|---|---|
| 495764 | 11/1938 | United Kingdom | 33/245 |
| 600864 | 4/1948 | United Kingdom | 33/233 |

*Primary Examiner*—Harry N. Haroian

*Attorney, Agent, or Firm*—Wells, St. John & Roberts

[57] ABSTRACT

An optical sight for use in aiming firearms, archery bows and other visually aimed devices. The sight includes a rigid supporting frame. The frame supports an optical lens that is ground to produce a magnified virtual image of a front sight. The front sight image is located with a top edge of the lens along an image line of sight that is substantially parallel to the operative axis of the device. The eye does not have to accommodate by focusing between a front sight, rear sight and target since the target and sight image remain clear. The front sight image will "disappear" from the visual boundaries of the lens when elevational adjustment of the device is made, without obstructing view of the target.

19 Claims, 12 Drawing Figures

OPTICAL SIGHT

BACKGROUND OF THE INVENTION

A constant problem for the user of any visually aimed device, such as a pistol, rifle, bow and arrow, etc. having "open" sights (a front sight member and an axially spaced rear sight vane), has been focusing the aiming eye between the rear sight vane, the front sight, and the target. Because of relative spacing between the three objects, this is physically impossible. At best, only one of the objects can be in focus at a time. Thus it is usually necessary to allow the rear sight vane to become blurred due to its proximity to the eye. The front sight or the target then must also become blurred. This system is at best a compromise.

Telescopic sights represent a vast improvement over "open" sights by producing an enlarged erect image of the target to the aiming eye. "Cross hairs" built into telescopic sights indicate the point of projectile impact on the target. The cross hairs and enlarged target image both appear in focus if the optics are properly adjusted.

An optical non-telescopic sight for hand guns is produced by Precision Reflex Inc., P.O. Box 95, New Breman, Ohio 45869 in which an optical system is used in an open ended tube along with a "cross hair" reticle. There is no magnification involved, and the cross hair is used as the only reticle centered on the target. The front sight does not become involved, as both front and rear sights are replaced by the cross hair. The device is relatively compact and easily mounted to small weapons such as pistols for improved sighting purposes.

Most optical sights such as the telescopic sights described above have several drawbacks. They increase the bulk and weight of the weapon; they are relatively easily damaged; they are often as expensive as the weapon itself; they are at times subject to weather conditions (fogging in cold weather); and they typically eliminate the use of the old "open" sight system as an alternative when placed on weapons having existing sight systems. Another difficulty with telescopic sights is the reduced field of vision presented to the shooter. It is often very difficult to adjust between normal vision and telescopic vision. The result is that the target is often lost through a telescopic lens when it is easily visible to the naked eye.

The field of vision problem is improved by lower power telescopic sights. The "Precision Reflex" pistol sight, since it has no magnification power, presents no field of vision problem. However, the cross hairs are used as the sole reticle and accuracy may be severely affected if the cross hairs are not centered (by the shooter's eye) within the tube at the time of firing.

Aperture or "peep" sights make use of a rear sight "disk" with a small aperture which defines a circular opening. The front sight post is "centered" in the apertured disk for sighting purposes. These sights have the advantage over usual "iron" sights in that the rear sight disk can be somewhat ignored by the aiming eye so only the front sight and target need be focused on. An example of an aperture or "peep" sight is disclosed in the 1931 U.S. Pat. No. 1,834,248 to Lorenzen. Lorenzen also discloses a "peep" type front sight. Sighting techniques used by the Lorenzen sight arrangement are similar to those typically used for aperture sights. Use of this type of sight depends significantly on the eyesight of the shooter. The small diameter opening can also become fouled. However, the principal disadvantage is that for efficiency the aperture must be located as close to the aiming eye as possible. Because greater accuracy is possible with close disk-eye distances, effective use of "peep" sights is limited by the recoil of high power rifles and the very nature of pistols (which must usually be held at arm's length).

Another difficulty with open sights is discovered when it is necessary to aim at a target beyond the range at which the sights were initially set. Accommodation must be made by raising the projectile trajectory. This can be done with some weapons by elevating the rear sight so the muzzle has to be raised to bring the front sight into proper alignment. The elevation of the eye must also be elevated with respect to the weapon, often to the discomfort of the shooter. The other alternative is to hold the rear sight at the same elevation and raise the front sight (along with the muzzle of the weapon). This is not done because the front sight quickly obscures the view of the target.

Optics have been used with limited success in sight systems. Shooters with failing eyesight can fit their weapons with prescription ground "peep" sight disks. One such device is disclosed in U.S. Pat. No. 1,964,927 granted in 1934 to F. E. Bliss. The Bliss sight combines a standard "peep" sight base with a circular prescription ground lens as the disk aperture. The lens provided is used merely to correct for vision defects of the shooter. The device does not substantially change the normal sighting procedure. It merely does away with the need for the shooter to wear glasses or other optical corrective devices when shooting. A front sight arrangement shown in the Bliss patent includes extra front sight posts spaced laterally of the conventional center post. These sights can be used for "leading" a moving target. Range adjustments are made in the usual way; by raising or lowering the rear optical sight.

U.S. Pat. No. 2,906,160 granted in 1959 to Palley describes a range finding sight device that makes use of a specially ground optical lens coupled with an axially spaced pair of cross hair reticles. In sighting with the device, the proper cross hair arrangement must be selected and aligned with the target through the lens. Since the cross hairs are behind the lens, the same focusing problem exists as with open sights, only to a somewhat reduced degree due to the relative proximity of the spaced cross hairs. It is important to note that the lens is a convex-concave type with a positive diopter value for off-setting the image of the target, not the front sight. The normal front sight of the weapon is not used. It is replaced by the front set of cross hairs directly behind the lens. The only function of the positive diopter value of the lens is in selecting a range sighting adjustment that does not require physical movement of the sights relative to the weapon.

U.S. Pat. No. 2,420,252 to E. H. Land granted in 1947 discloses an interference sight for guns, cameras, etc. that accommodates varying angular positions between the shooter's eye and the sight reticle. The single reticle is the only one provided (as with standard telescopic sights) so two axially spaced sights needn't be aligned for sighting purposes. It is further disclosed that the reticle is impressed on the shooter's field of view at optical infinity. The reticle therefore remains in focus with the target. Also, the reticle is an image rather than a real object. Due to the physics of the lens, the reticle will "move" within the confines of the lens when the angle of the shooter's eye changes. This can be done without significantly changing the point of impact for the projectile. Again, it is pointed out that the front sight is eliminated completely, with accuracy depending entirely upon positioning of the reticle with respect to the projectile trajectory. Land discloses that range adjustments can be made with his interference sight by gauging distances between interference rings that appear in the sight image.

The range problem discussed above becomes more acute with short range weapons such as bows and other arrow or heavy projectile launching devices. Extreme angular changes in the initial projectile axis must be used for increasing range distances. Typical bow sights must therefore become rather bulky and complex to accommodate the wide range of angular positions at which the weapon must be fired in order to maintain reasonable accuracy. An excellent example of such a sight is disclosed by Crook in U.S. Pat. No. 3,027,648 granted in 1962. Crook's archery sight includes several mechanical adjustment features for setting a single sight post or reticle to compensate for distance, wind, etc.

A substantially simpler device is disclosed by Steiber, in the 1951 U.S. Pat. No. 2,574,599. Steiber uses a single upright notched plate as the front sight reticle for bows. The rear "sight" is comprised of a "bead" on the bow string. When the bow string is fully drawn, the bead is located very close to the aiming eye and is therefore out of focus with the target and front sight.

The need therefore remains for a sight system that does not produce the focus disadvantage of open iron sights, the range adjustment of and eye proximity problems of aperture sights, the multiple disadvantages of telescopic sights, and the accuracy difficulties presented with single reticle sights that have all remained basically unimproved until the advent of the present invention.

The present sight arrangement represents a remarkable improvement over any known form of general use sight. By making use of an axially spaced visual image aligned substantially parallel to the projectile axis, the present sight offers an unquestionable sight "picture" and a corresponding high degree of accuracy. Accuracy is significantly enhanced by visual magnification of the perceived image of the front sight member. Slight movement of the front sight member is also magnified so the user might become more aware of such movement and take steps toward correction. The front sight is an "image" within the rear sight lens and, as such, will "disappear" progressively as the image is raised or lowered out of the field of view for the lens. This feature is significant in that range adjustments can be made merely by raising or lowering the discharge angle of the device without the need for making physical sight adjustments. The lens used in the rear sight of the present invention is inexpensive to manufacture and can be mounted to a wide variety of firearms or other visually aimed devices. This can be done without obscuring the normal function of existing sight arrangements since the present lens structure can be positioned clear of the existing line of sight used for any existing sight system, including open, aperture, or telescopic sight systems. Either one of the two systems can therefore remain as an auxiliary sight system should the other system become unusable.

DETAILED DESCRIPTION OF A PREFERRED EMBODIMENT

Figure 1:
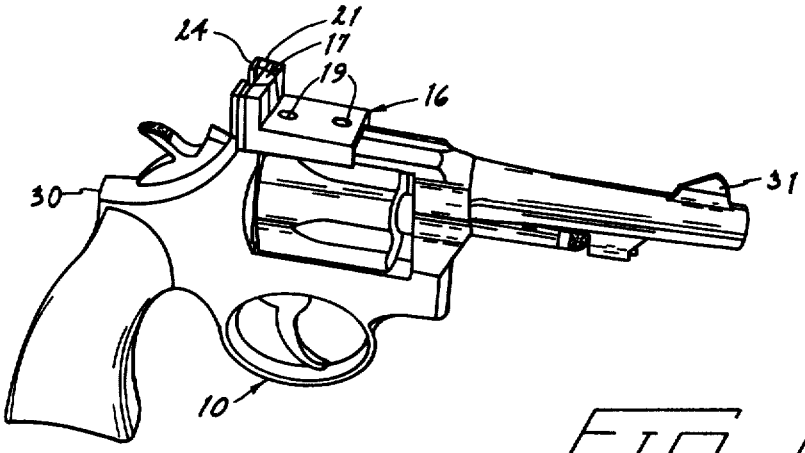
FIG. 1 is a pictorial view of a revolver having the present optical sight mounted thereto.

This device relates to visually aimed devices having an operative axis adapted to be directed toward a remote target. The term "visually aimed device" encompasses all types of apparatus for projectile firing, such as revolvers, pistols, rifles, shotguns, cross bows, long bows, spear guns, grenade launchers, rocket tubes and the like. It further includes devices for directing a stream of liquid, a beam of light or other active elements toward a receiving target. The optical sight might also be usable in conjunction with targeting of receivers for light-encoded signals, sounds or electronically originated signals of any manner. In all such devices, aiming of the device requires that the operative axis, such as the bore axis of a rifle, be optically aimed or directed toward a remote target with ease and accuracy.

The frame for the sight elements can be separate from the visually aimed device and added to it as an attachment or modification (FIGS. 1-5) for support of only the rear sighting lens and vane. In such arrangements, the device itself is part of the frame and mounts the front sight. The frame in some instances might mount both the rear and front sight components as a separable or integral part of a device having no pre-existing sight elements, such as the bow shown in FIG. 10. The term "frame" as used herein shall refer to any form of support for locating the sight components on a visually aimed device and can be separable from it or can be partially or totally integral with it. It can be fixed in location or movably adjustable with respect to the device.

The first form of the invention is shown in FIGS. 1-5 as it would be applied to a conventional revolver 10. The revolver has an operative axis 12 through the center of its cylindrical barrel, along which a projectile (bullet) is fired toward a target (not shown). The revolver includes a front sight member 31 having a viewable rear surface area across which are formed a plurality of parallel lines 29. Lines 29 serve as a first visual reference for the present optical sight and are located when in use at a position offset to one side of the axis 12.

Frame 16 is shown in the drawings for mounting the present sight to revolver 10. The frame in FIGS. 1 through 5 is used to support a transparent lens 17 and rear sight assembly.

The frame 16 illustrated in FIGS. 1 through 5 is "L" shaped and has apertures 18 formed therethrough to receive mounting screws 19. The screws 19 serve as means for mounting the frame to the revolver 10. Other appropriate clamping devices or securing apparatus might be used. The frame could also be integral with the revolver frame 10.

Figure 2:
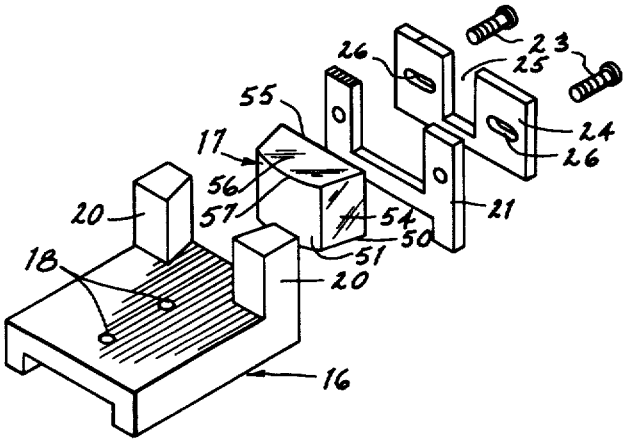
FIG. 2 is an exploded pictorial view of a rear vane and lens arrangement for the present invention.
Figure 3:
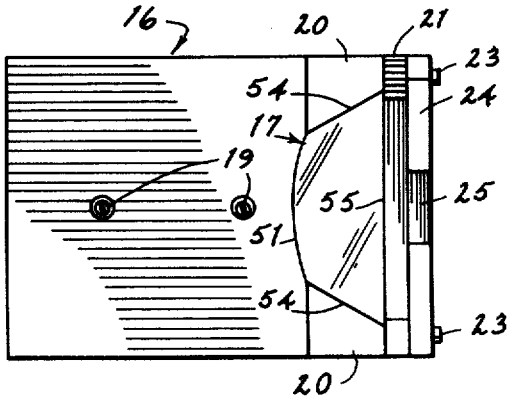
FIG. 3 is an enlarged plan view of the assembled arrangement shown in FIG. 2.

Upright legs 20 are provided at one end of the "L" shaped frame 16 (FIG. 2). The legs 20 are parallel and spaced apart to receive the lens 17. A clamp member 21 may be provided to secure the lens between the frame legs 20. The clamp member may be an integral part of the frame 16 with the lens press fitted to the frame. In the example shown, mounting screws 23 are provided to secure the separate clamp member 21 to the frame and thereby hold the lens in position.

A sight vane 24 is also mountable to the frame directly adjacent the lens 17. The vane includes a notch 25 that is formed to complement the general shape of an image of the front sight member viewable through the lens 17. The size of notch 25 is determined to accomodate the full "image" 13 of the rear surface of the front sight, including the image height and width. Transverse slots 26 are provided in the vane 24 to receive the mounting screws 23 that extend into the frame legs 20. The slots 26 allow selective lateral movement of the notch 25 for adjustment purposes.

Figure 10:
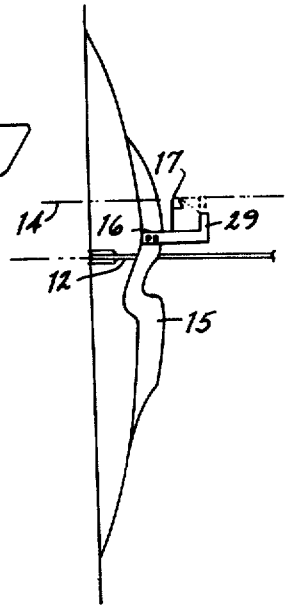
FIG. 10 is an elevational view exemplifying use of the present arrangement with an archery bow.

An alternate form of the frame 16 is shown in FIG. 10. This form is particularly adapted to mount the lens 17 and a front sight member 29 to a bow 15. The frame is mounted in such a way that an image line of sight 14 is produced between the lens 17, front sight image 13 and a target (not shown) that is substantially parallel with the central longitudinal axis 12 of a properly "nocked" arrow. Function of the bow sight arrangement is basically similar to that of the separate front and rear sight arrangements that will be discussed in greater detail below.

Figure 7:
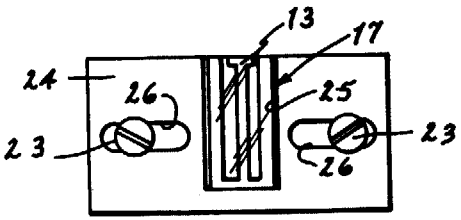
FIG. 7 is a view similar to FIG. 6 showing the image of another modified form of front sight member.
Figure 8:
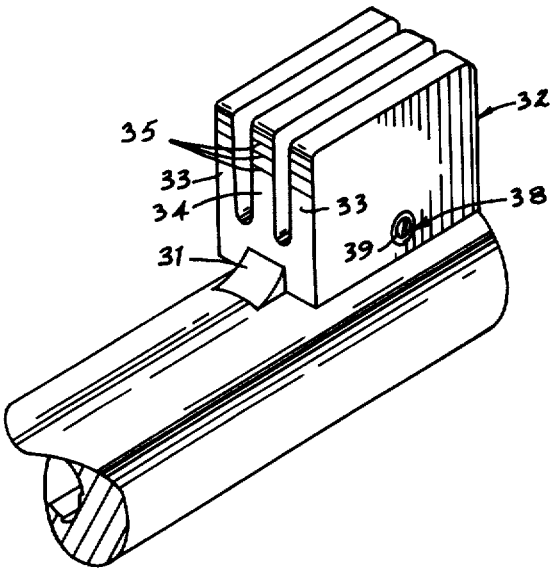
FIG. 8 is a pictorial view of the front sight arrangement shown in FIG. 6.
Figure 9:
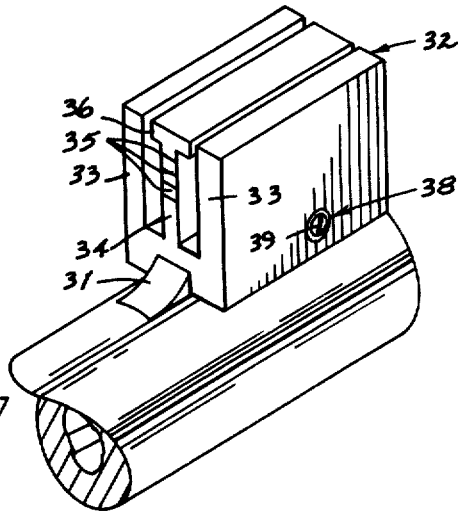
FIG. 9 is a view similar to FIG. 8 illustrating the form of front sight member shown in FIG. 7.
Figure 11:
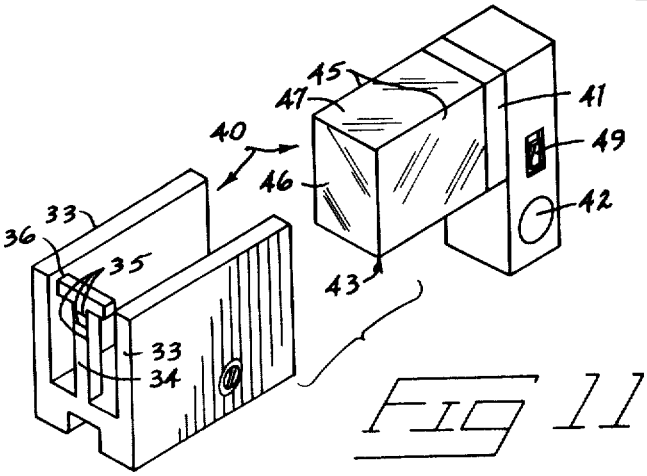
FIG. 11 is an exploded pictorial view of a lighted front sight member.

Modified front sight members 32 are illustrated in FIGS. 8, 9, and 11. Their resulting "images" 13 are shown in relation to the lens and rear sight vanes 24 in FIGS. 6 and 7. The front sight image 13 illustrated in FIG. 5 is of a normal, existing front sight 31 supplied on the pistol 10 shown in FIGS. 1 and 4.

The modified front sight members 32 are provided to replace or supplement existing front sight arrangements on firearms or other forms of visually aimed devices. They can also be used on devices which have no existing front sight members.

The front sight members 32 may include opposed upright ears 33 that are spaced equally to opposite sides of an upright center post 34. The ears are provided to protect the center post 34 and to laterally bracket the post. The center posts 34 and upright ears 33 produce images 13 as shown in FIGS. 6 and 7 that substantially fill the rear sight notches 25.

The center posts 34 are provided with spaced lines or gradations 35 that correspond to various distances from the device. Each line is capable of serving as a first visual reference for sighting purposes. Each gradation will define, along with a top edge 55 of lens 17, an image line of sight 14 that will intersect the trajectory of the projectile at selected distances from the device.

Figure 6:
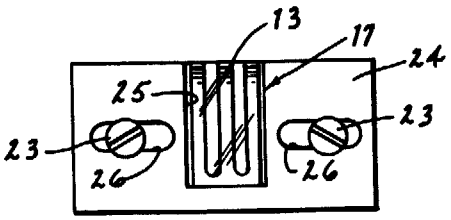
FIG. 6 is an enlarged rear view illustrating a rear lens and image for a modified front sight member.

The center posts 34 may be substantially vertical as shown in FIGS. 6 and 8, or "T" shaped as shown in FIGS. 7, 9, and 11. The "T" configuration of the front sight post includes a cross member 36 that resembles a "cross hair" commonly used in telescopic sights. The cross member 34 also gives the shooter a more defined area of reference at the post top edge, which is another form of the first visual reference.

Front sight mounting means 38 are provided to secure the front sight members 32 to the launcher. The set screws 39 shown in FIGS. 8 and 9 can be used for this purpose to secure the front sights to existing revolver front sight assemblies. It is also understood that an alternate form of the mounting means 38 can be provided in the form of a dovetail arrangement (not shown) adapted to slide laterally into an existing sight base commonly provided in sporting rifles. Other forms could also be used, including split rings that would facilitate clamping to smooth circular surfaces such as the muzzle of a shotgun.

FIG. 11 shows an illuminated front sight member 40. This arrangement is somewhat similar to the front sight illustrated in FIG. 8 with the exception that it is illuminated to facilitate nighttime shooting. The illuminated sight 40 includes a source of light such as a light emitting diode (LED) 41. Electrical energy is supplied to the light source from a power source 42, such as a small battery. The light 41 and power source 42 are mounted together in relation to a light transmitting block 43.

The block 43 functions as means for directing light from the LED rearwardly against a narrow center post 34. The block includes opposed upright sides 45 that will slidably fit between inwardly facing surfaces of the sight ears 33. The rear face 46 of the block is clear, while a top surface 47 is opaque. The clear rear face 46 of the block, when assembled, is situated closely adjacent to the center post 34. Light emitting from the block will therefore sharply silhouette the post periphery but will not escape upwardly through the surface 47.

An appropriate switch 49 can be provided to allow selective illumination of the front sight in its lighted mode. This sight arrangement facilitates both night shooting and daylight shooting in any situation where the target can be clearly viewed.

A distinct advantage of the illuminated sight arrangement is the confined rearward direction of the light emitted from the block 43. A relatively dim light can be used to illuminate the center post and, because of its rearward direction, cannot be detected except from behind. Other advantages of the lighted sight arrangement will become evident following a more detailed description of the lens arrangement 17.

The lens means 17 generally referred to above is a very important element of the present invention. The lens means 17 will produce a virtual, erect and magnified image 13 of a front sight member 31 or 32 along an image line of sight 14 offset from the projectile axis 12 and converging slightly toward axis 12 to the target area.

Figure 12:
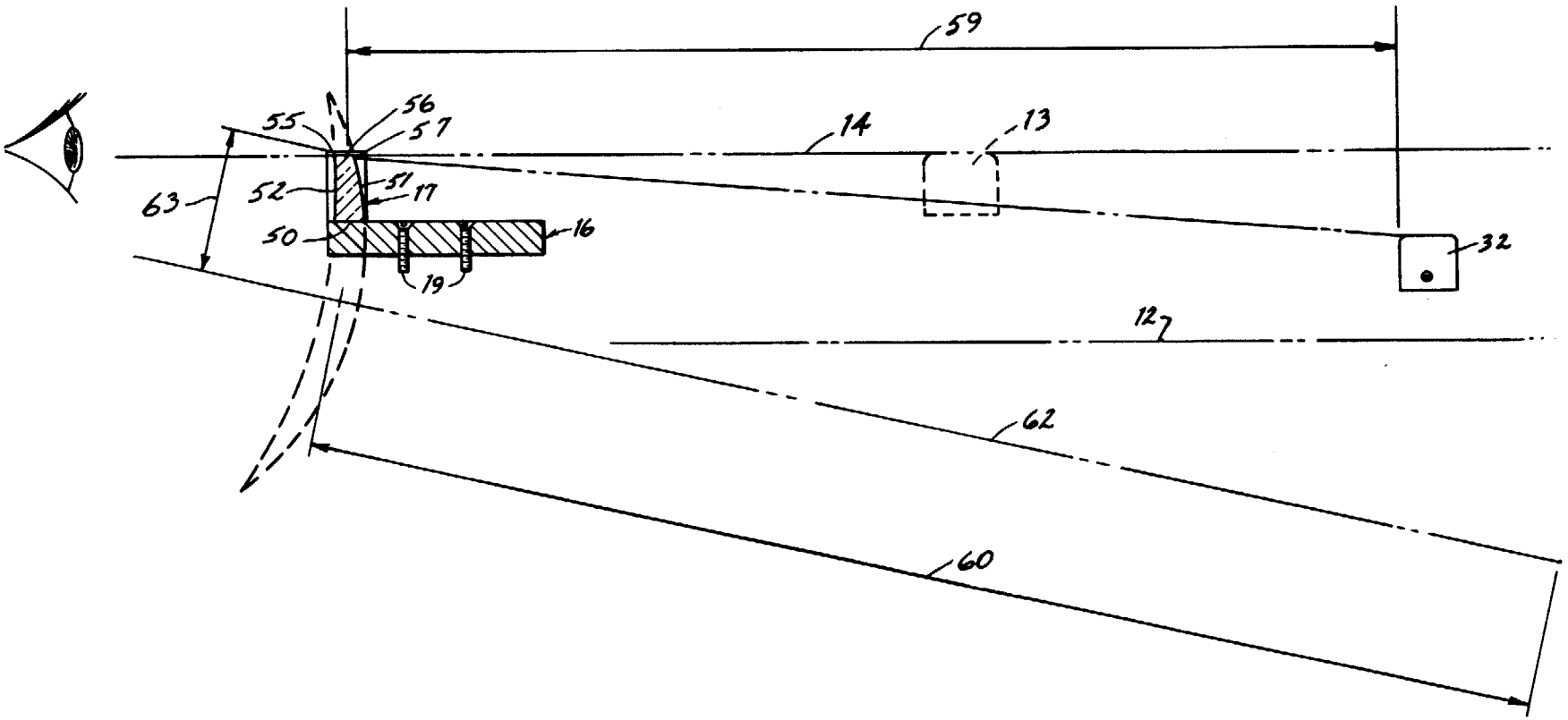
FIG. 12 is a diagrammatic view illustrating a meniscus lens and a section thereof to be used as the lens member of the present invention.

The lens is preferably a meniscus (spherical) form of lens although it is understood that other lens forms (i.e. plano-convex) can be used (see FIG. 12). The meniscus lens configuration is preferred because both the convex front surface 51 and concave back surface 52 will substantially reduce undesirable reflections. It is also preferred that the lens be coated to further reduce reflection and chromatic abberation. Such coatings are well known in the optics arts. Abberation can also be reduced by producing the lens means as a number of interfitted complementary lenses. Such combinations are also well known in the optics arts and will not be specifically discussed herein.

The peripheral configuration of the lens 17 may vary depending on the shape of the opening between the upright legs 20 of the frame. The opening illustrated in FIGS. 1 through 7 is substantially rectangular. Consequently, the general peripheral configuration of the lens will be substantially rectangular. It is preferred, however, that the lens include upright tapered sides 54 complementary to the inwardly facing sides of the upright legs 20 to assure a secure mount between the lens and frame. The bottom surface 50 of the lens is preferably flat to rest flush against the base of the frame.

The tapered sides 54 are spaced apart by the bottom surface and a top edge 55 that is used as a second visual reference in the sight. The top edge 55 is situated at an upper end of a beveled top surface 56. The top edge 55 lies along a line of intersection between the beveled surface 56 and the concave back surface 52. The edge 55 is shown as a point in FIG. 12 and as a straight line in FIGS. 2 and 3.

The beveled top surface 56 extends angularly from the top reference edge 55 to a front edge 57. The edge 57 is spaced toward the bottom lens surface from the top edge 55, forming a bevel angle with respect to the axis 12. It is preferred that this angle be substantially parallel to a ray passing through the lens as reflected from a point along the top of the center post 35 of an associated front sight member. The image viewed through the lens will therefore be clear and sharp, especially at the edge 55. It is preferred that the beveled surface 56 be made opaque to confine passage of light rays through the lens to those passing substantially horizontally through the lens.

The optical properties of the lens are selected in view of the desired relationship with the front sight member, whether existing or attached. One of the important considerations is the "sight radius" 59 (FIG. 4) or the distance between the front and rear sight elements. This distance may be substantially equal to an existing sight radius where other forms of front and rear sight members are provided on the device. It is preferred that the sight radius be as long as possible for reasons of accuracy. Therefore, the lens 17 is preferably mounted near to or behind any existing rear sight.

Another consideration is the focal length 60 of the lens. The front sight member must be within the focal length of the lens. That is to say, the distance from the lens to the rear surface of the front sight member must be equal to or less than the lens focal length. Preferably, the lens focal length is slightly greater than the sight radius 59 so the image will be enlarged and upright. The magnification ratio is determined in view of the size of the front sight and the notch 25 of the rear sight vane. Magnification should be such that the front sight image 13 will nearly fill vane notch 25 as shown in FIGS. 5 through 7.

The steps involved in selection of the correct degree of prism for the lens to produce an offset image 13 of the front sight member may best be understood by the following example.

Figure 4:
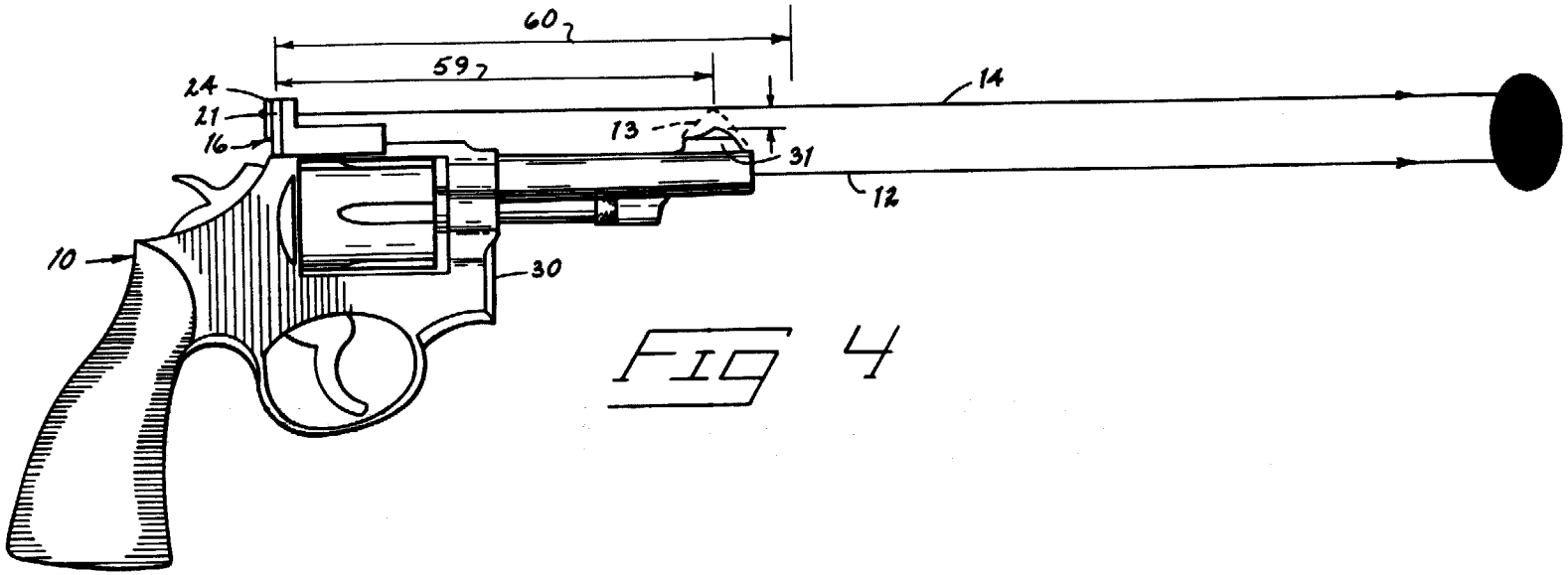
FIG. 4 is a diagrammatic view illustrating the present invention in use on a revolver.
Figure 5:
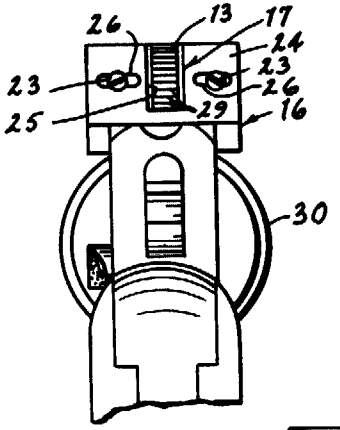
FIG. 5 is a fragmentary rear view illustrating the rear lens and front sight "image"

Assuming that revolver 10 shown in FIG. 4 and diagrammatically in FIG. 12 has a sight radius 59 of 180 mm and a height desired above the existing rear sight of 10 mm, a lens must therefore be selected that has a focal length 60 greater than 180 mm; or 200 mm, giving a diopter value of 5. Next, the amount of prism needed to produce a front sight image 10 mm from the actual front sight must be calculated. It is known that one degree of prism will deviate a normal line of sight or a ray 10 mm at one meter (1,000 mm). An equation therefore exists, e.g.: $10/180 = X/1{,}000$ In solving the above equation for "X," a value of 55.56 mm of deviation at one meter, or 5.556 degrees of prism is calculated. It now becomes possible to determine how the lens must be cut in order to produce such deflection of the perceived image in the lens.

First, a relationship must be established between the unknown lens dimension and focal length; and the sight offset and sight radius. This can be expressed by the equation: $X/200 = 10/180$.

In solving for X, a distance of 11.11 (shown diagrammatically at 63 in FIG. 12) is obtained. This, then is the distance 63 from the lens axis 62 (FIG. 12) to the point on the lens that will produce 5.556° of prism. Thus, if the cut edge 55 of the lens is positioned 10 mm above the previous line of sight, the image produced through the lens will have a top edge 10 mm above the old line of sight. A new line of sight 14 is thereby formed exactly 10 mm above the old line of sight and substantially parallel to the axis 12.

Lens properties can be easily selected for the arrangement as shown in FIG. 10, where the front and back sights are mountable to the same frame. The lens, however, will provide the same basic features as described above.

The steps involved in mounting the present sight arrangement to a particular device vary with the nature of the individual device. When the frame mounts both the lens 17 and the front sight post 29 as in FIG. 10, the frame may simply be attached to the device with the base of the frame reasonably parallel with the operative axis. The lens and sight post will be in nearly correct alignment and can be easily adjusted for accuracy.

The L-shaped frame 16 mounting the single lens 17, however, is attached to the device separately from the front sight. Here, the frame should be clamped or otherwise attached to the device at a specified sight radius from the front sight.

It should be noted at this point that the position of the lens 17 based on the calculations given in the above example assumes the lens to be positioned within a vertical plane passing through the operative axis. This position will be typical for most arrangements. However, in some circumstances, it may become desirable to offset the lens laterally of the operative axis 12. If this is to be done, the lens will require a compound prism quality to compensate for the lateral lens offset. The same basic calculations can be used to determine the prism required for the amount of lateral offset as for the elevational offset discussed above. The resulting lens could therefore have a prescribed degree of prism compounded in two directions to produce an image of the front sight along a line of sight that is parallel with the operative axis, but spaced laterally therefrom.

Regardless of the lateral frame position in relation to the operative axis 12, it is desirable to mount the frame to the revolver or other device so the longitudinal dimension between the lens and the front sight member is slightly less than the focal length of the lens. The top edge of the lens must also be positioned at the desired height above the previous line of sight to produce the required amount of offset for the front sight image 13.

In situations wherein the frame 16 and lens 17 are used in conjunction with a device having an existing front sight arrangement as shown in FIGS. 1 and 4, there is no need for further assembly. If no such sight arrangement is provided, however, or if the existing front sight arrangement is to be replaced, one of the front sight members shown in FIGS. 8, 9 and 11 must be attached to the device. This may be done simply by loosening the set screw, sliding the sight member over the existing sight, and tightening the set screw into position. Other known forms of attaching mechanisms can be used where there is no existing front sight arrangement. Placement of the front sight member must be accomplished with care so as to assure that the center post is within the focal length of the lens 17 and at the desired sight radius.

During operation, the user holds the device so that the lens 17 is located in front of the aiming eye and is aligned with the selected target. The shooting eye will focus on the target. As a consequence, the rear sight vane will appear blurred. The front sight image, however, will stay in focus due to the properties of the lens 17. There is therefore no substantial difficulty in focusing between the two visual references of the sight members and the target. This is accomplished by visually superimposing the images of the first visual reference (front sight member) and a target area as viewed through lens 17 with the second visual reference (edge 55) on lens 17. The manner by which this is accomplished optically is schematically shown in FIG. 12.

The user would hold revolver 10 so the image of the front sight formed through the lens 17 fills the entire rear sight vane 24. The top edge of the center post 34 or cross member 36 should be aligned with the top reference edge 55 of the lens, and with the target. This aiming process is quickly learned by the user. The user determines when the proper alignment has been visually achieved. When it has, the revolver can be fired accurately with respect to the target area.

Shooting accuracy is substantially increased through use of the present arrangement due to the magnification factor involved between the lens and the front sight member. Movement of the magnified front sight image is accentuated by the lens. Such movement will be easily recognized by the user and corrected.

The image of the front sight member, because it is only an image, is visible only within the confines of the lens. Therefore, if the image 13 is raised above the line of sight 14, that part of the post image above the sight line will "disappear." The target and remainder of the post below the line of sight will remain in clear focus. One of the gradations along the length of the post can then be aligned with the sight line, depending upon the estimated distance to the target. For example, if a target is located say, 100 meters from the revolver, and the sights are initially "zeroed" in at 100 yards, the user will simply align the top of the center post image with the top rear edge 55 of the lens. A target at a further distance (such as 200 meters) requires a higher projectile trajectory. The end of the revolver at the front sight member can then be raised until the post top disappears above the top edge 55 of the lens, and an appropriate gradation or other visual reference appears in alignment with the top lens edge 55. The gradation selected should correspond to the target distance. The top of the post will not interfere by covering the target since its image is no longer visible.

The advantages of the present lens arrangement are amplified when the lens is used with an illuminated front sight. The bright silhouette appears clear and enlarged through the lens and can be easily and quickly aligned with the target. Without the lens, as with ordinary "iron" sights, the lighted front sight would blur and not be sufficiently effective to warrant its use.

The optical sight might require some minor adjustment following mounting for calibrating target distance. Such adjustments may be made by either shifting the lens along the axis to adjust for elevational change or by shifting the rear sight vane laterally to adjust for lateral change.

If, for example, a fired projectile strikes below the target, the lens may be moved closer to the front sight member. This increases the angle of incidence of rays reflecting from the front sight to the lens. The image will therefore appear to be lower than it was originally. The front sight must then be raised to bring the image into proper alignment and the resulting projectile trajectory is higher.

If the projectile strikes above the target, the lens can be moved away from the front sight to correspondingly raise the image and require that the front sight be lowered to achieve proper sight alignment.

Lateral adjustment is performed much the same way as for existing "iron" sights. The rear sight vane may be shifted to the left or right to change the projectile impact to the right or left. The front sight can also be used for this adjustment if desired, since it may also be shifted left or right.

The above description and drawings have been given by way of example, it being understood that other forms and variations of the present invention may be readily comprehended by persons of ordinary skill in the art of optics and of design and construction of sighting apparatus.

Having thus described my invention, what I claim is:

1. An optical sight for a visually aimed device having an operative axis adapted to be directed toward a remote target, comprising:

a front sight member having a viewable rear surface area, said rear surface area having a first visual reference thereon adapted to be offset from the operative axis of the device;

lens means rearwardly of the front sight member for enabling a user to view the front sight member when the device is pointed toward a remote target, the separation between the lens means and rear surface of the front sight member being within the focal length of the lens means;

a second visual reference located on the lens means; the second visual reference being offset from the operative axis of the device by a distance greater than the offset of said first visual reference;

said lens means having positive refractive properties for producing a visual erect and enlarged image of the rear surface of the front sight member along an image line of sight intersecting said second visual reference and offset from the operative axis of the device, whereby the device can be aimed by visually superimposing the image of the first visual reference and a target area as viewed through the lens means with the second visual reference on the lens means.

2. The sight as claimed by claim 1 wherein the front sight member includes vertically spaced gradations facing rearwardly, for indicating lines of sight corresponding to selected distances from the visually aimed device.

3. The sight as claimed by claim 1 wherein the front sight member is comprised of:

an upright center post;

a pair of upright front sight ears spaced to opposite sides of the upright post; and means for attaching the front sight member to the visually aimed device.

4. The sight as claimed by claim 3 wherein the upright post is "T" shaped with the cross-bar of the "T" shape defining the image line of sight with the second visual reference on the lens means.

5. The sight as claimed by claim 1 wherein the front sight member includes:

an upright sight post; and means for illuminating the upright sight post.

6. The sight as claimed by claim 5 wherein said means for illuminating the upright sight post is comprised of:

a light emitting diode;

a power source connected to the light emitting diode; and light transmitting means connected to the light emitting diode for directing light in a direction toward the lens means and against the upright sight post.

7. The sight as claimed by claim 1 wherein the frame mounts the front sight member and the lens means, and is adapted to be mounted as a unit to the visually aimed device.

8. The sight as claimed by claim 1 wherein the lens means is comprised of a positive power meniscus lens.

9. The sight as claimed by claim 1 wherein the lens means includes:

an inclined surface leading from the second visual reference toward the front sight member and the operative axis.

10. The sight as claimed by claim 1 further comprising:

a frame mounting the lens means; and vane means on the frame directly adjacent the lens means for restricting the field of view through the lens means to accomodate the magnified image of the front sight.

11. The sight as claimed by claim 10 further comprising:

means mounting the vane means to the frame for adjustment thereof to selectively change the image line of sight with respect to the operative axis.

12. An optical rear sight for a visually aimed device having an operative axis adapted to be directed in a forward direction toward a remote target, and wherein the device includes a front sight member, said optical sight comprising:

transparent lens means having a fixed focal length and refractive properties adapted to produce a magnified virtual image of the front sight along an image line of sight spaced from the operative axis and from the front sight member; and means for mounting the lens means to the device at a position thereon rearward of the front sight member and spaced from the operative axis and along the image line of sight so the lens means may produce a virtual erect and magnified image of the front sight that is offset from the operative axis by a distance greater than the distance between the front sight member and the operative axis.

13. The optical rear sight as claimed by claim 12 wherein the lens means is comprised of a positive power meniscus lens.

14. The optical rear sight as claimed by claim 12 wherein the lens means includes:

a visual reference adapted to define the image line of sight with the front sight; and an inclined surface adapted to lead from the visual reference edge forwardly and toward the projectile axis.

15. The optical rear sight as claimed by claim 12 further comprising:

vane means on said means for mounting the lens means, directly adjacent the lens means for restricting the field of view through the lens means adapted to accomodate the magnified image of the front sight.

16. The optical rear sight as claimed by claim 15 further comprising:

means mounting the vane means to the means for mounting the lens means, adapted for adjustment thereof to selectively change the image line of sight with respect to the operative axis.

17. The optical rear sight as claimed by claim 12 wherein the lens means includes a visual reference adapted to define the image line of sight with the front sight.

18. The optical rear sight as claimed by claim 12 further comprising a sight vane directly adjacent the lens means, adapted to accomodate the magnified image of the front sight;

wherein the sight vane includes an upwardly open notch; and wherein the lens means includes a visual reference spanning the open notch of the sight vane, adapted to define the image line of sight with the front sight.

19. The optical rear sight as claimed by claim 12 wherein said means for mounting the lens means to the device is comprised of a frame means for mounting the lens means securely and adapted to be attached to the device rearwardly of the front sight member thereof.

* * * * *